United States Patent [19]

Hirata et al.

[11] 3,942,291

[45] Mar. 9, 1976

[54] ARTIFICIAL LAND STRUCTURE FRAMEWORK

[75] Inventors: Yasuhiro Hirata; Shoichi Kobayashi; Nobuo Yamaguchi, all of Tokyo; Katshuhiko Saito, Kanagawa; Mamoru Kimura; Yoshitel Iwasa, both of Tokyo; Masatoshi Ueda, Kanagawa; Hideki Magara, Tokyo, all of Japan

[73] Assignee: Takenaka Komuten Co., Ltd., Osaka, Japan

[22] Filed: May 6, 1974

[21] Appl. No.: 467,209

[52] U.S. Cl. ..... 52/169 R; 52/648; 52/650; 52/DIG. 10

[51] Int. Cl.[2] ..... E02D 27/00

[58] Field of Search ..... 52/79, 169, DIG. 10, 648, 52/650, 654, 655; 182/179, 118

[56] References Cited

UNITED STATES PATENTS

| | | | |
|---|---|---|---|
| 624,782 | 5/1899 | Fuchs | 182/1 |
| 679,003 | 7/1901 | McRay | 482/118 X |
| 1,746,147 | 2/1930 | Duke | 52/650 |
| 2,584,066 | 1/1952 | Torkelson | 52/169 |
| 2,670,819 | 3/1954 | Stanley et al. | 52/650 |
| 2,986,241 | 5/1961 | Fuller | 52/655 |
| 3,685,221 | 8/1972 | Mangan | 52/DIG. 10 |
| 3,722,153 | 3/1973 | Baer | 52/DIG. 10 |
| 3,724,147 | 4/1973 | Levenson | 52/79 X |
| 3,791,081 | 2/1974 | Felcrai | 52/79 |
| 3,830,031 | 8/1974 | Soisson | 52/648 X |

FOREIGN PATENTS OR APPLICATIONS

| | | | |
|---|---|---|---|
| 1,034,101 | 6/1966 | United Kingdom | 52/236 |
| 528,712 | 11/1940 | United Kingdom | 52/655 |
| 93,653 | 3/1969 | France | 52/650 |

OTHER PUBLICATIONS

Civil Engineering – ASCE, January, 1973, pp. 70–73 "Disney World Hotel—"

*Primary Examiner*—Ernest R. Purser
*Assistant Examiner*—Leslie A. Braun

[57] ABSTRACT

An artificial land structure framework minimizing the destruction of nature such as hills and plants.

The framework has a plurality of beam members connected with each other to form a number of laterally disposed rectangular three-dimensional spaces, and artificial lands are stepwise provided along the diagonal lines of the three-dimensional spaces. The framework is of a truss structure with flexibility for modification, extension and reduction, and being able to have any desired number of layers of the artificial lands constructed on an inclined or flat ground.

6 Claims, 16 Drawing Figures

FIG 4. A
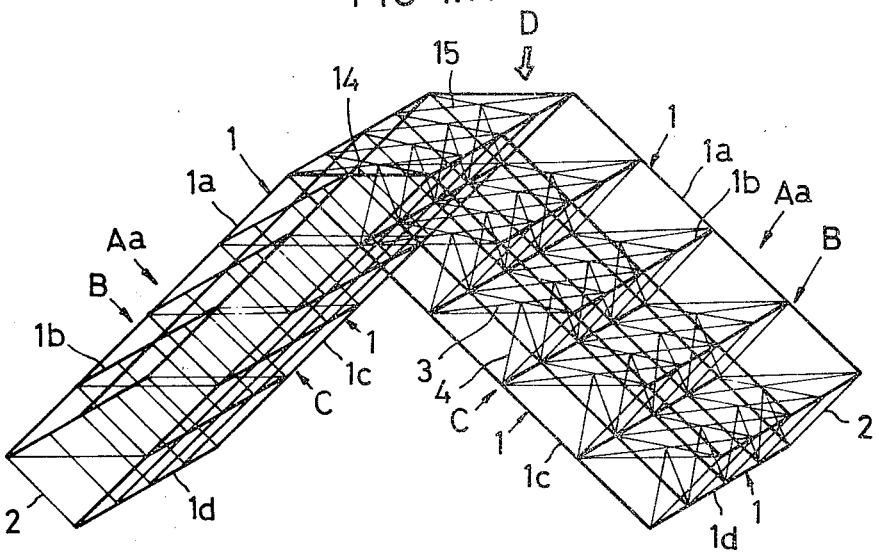
FIG 4. B
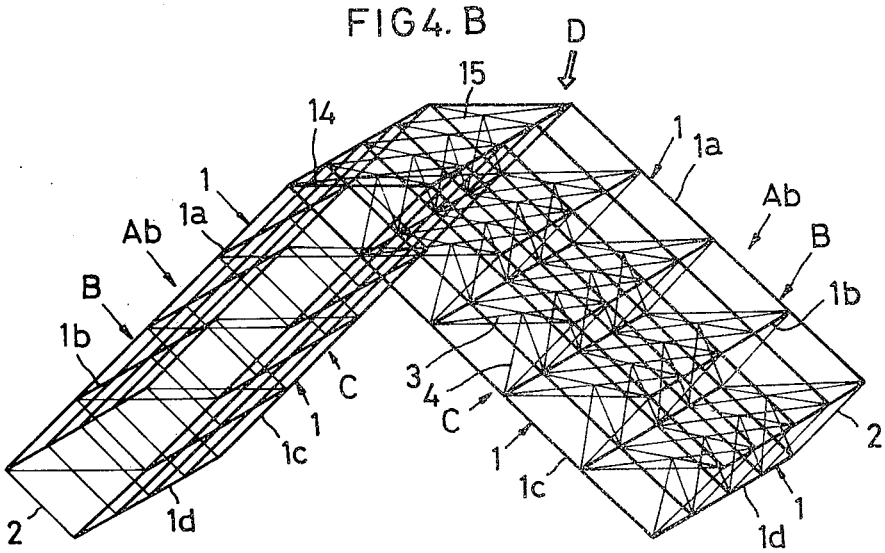

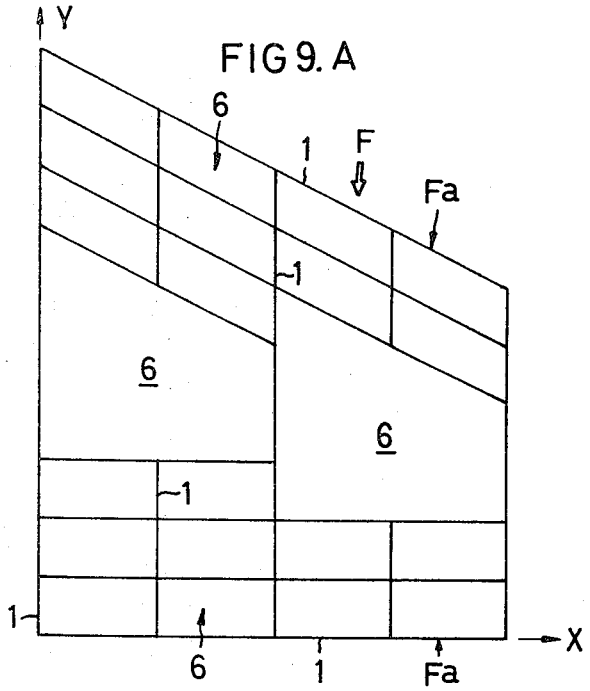
FIG 9. A
Y
X
6
1
F
Fa
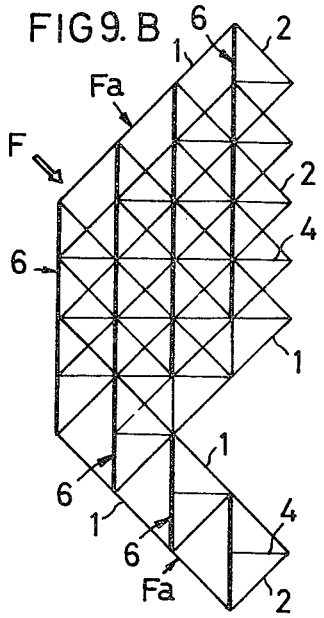
FIG 9. B
6
1
2
Fa
F
4
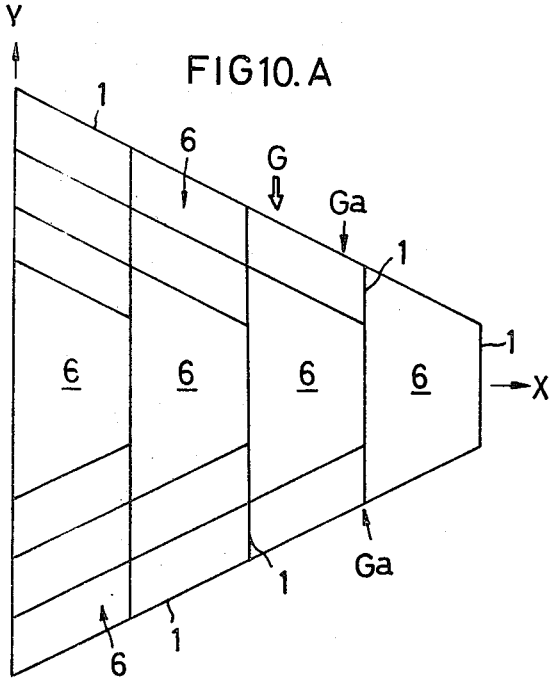
FIG 10. A
Y
X
1
6
G
Ga
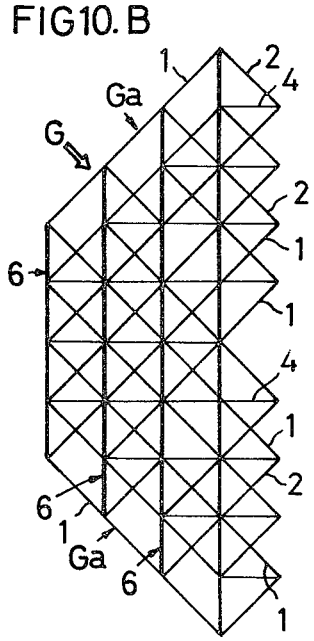
FIG 10. B
1
2
4
Ga
G
6

ARTIFICIAL LAND STRUCTURE FRAMEWORK

BACKGROUND OF THE INVENTION

This invention relates to an artificial land or ground structure framework and, more particularly, to a framework of a structure which enables effective three-dimensional utilization of a space.

The two-dimensional utilization of a space in the urban area will result in spacial congestion and, in addition, deterioration of environmental sanitation such as afforestation, sunshine and ventilation.

Under the above circumstances, various programs for three-dimensionally utilizing the urban area are in progress recently. As a result, an artificial land has come into existence which covers a predetermined area by a large-scale structure thereby forming a three-dimensional space structure and enabling the three-dimensional utilization of a space. However, an artificial land heretofore known is usually constituted as an enclosed space structure made of reinforced concrete or steel-reinforced concrete and, therefore, the underside space of its floor is dark and humid and cannot be utilized other than as a parking area. In addition, a conventional artificial land has disadvantages in that it is low in productivity because it requires much work to be done at the site including arrangement of reinforcement, concreting in site, etc., is poor in flexibility such as for extension or addition, and tends to destroy nature.

SUMMARY OF THE INVENTION

Therefore, it is an object of the present invention to provide artificial land structure frameworks which are light and useful for effectively utilizing the land at an existing city and for three dimensionally utilizing the urban area.

It is another object of the present inventon to provide artificial land structure frameworks which can constitute a large amount of inexpensive artificial land equipped with the city facilities and which can expedite environmental improvement of the residential space and solution of housing problems by preserving afforestation, sunshine and ventilation in the urban area.

It is still another object of the present invention to provide artificial land structure frameworks which can be fabricated in a short period from standardized component parts and which can be used for multiple purposes.

It is a further object of the present invention to provide artificial land structure frameworks which can be constructed on flat or inclined lands or on the water while minimizing the nature destruction.

It is still a further object of the present invention to provide artificial land structure frameworks which are of a trussed structure with a large axial force ratio and which have flexibility so that they may be subjected to various modifications, extension, reduction, and disassembly for re-use depending upon the change of city forms.

BRIEF DESCRIPTION OF THE DRAWINGS

Other and further objects, features and advantages of the present invention will be more apparent from the following description in connection with the following drawings in which:

FIG. 4A is a perspective view of a gabled artificial land framework similar to FIG. 3, but its main beam members being alternately thinned out;

FIG. 4B is also a perspective view of a gabled artificial land framework similar to FIG. 3, but its auxiliary beam members positioned in a zigzag relation being thinned out;

FIG. 9A is a plan view of a unilaterally tapered framework and FIG. 9B is a side view thereof;

FIG. 10A is a plan view of a bilaterally tapered framework and FIG. 10B is a side view thereof;

DESCRIPTION OF THE PREFERRED EMBODIMENTS

Figure 1:
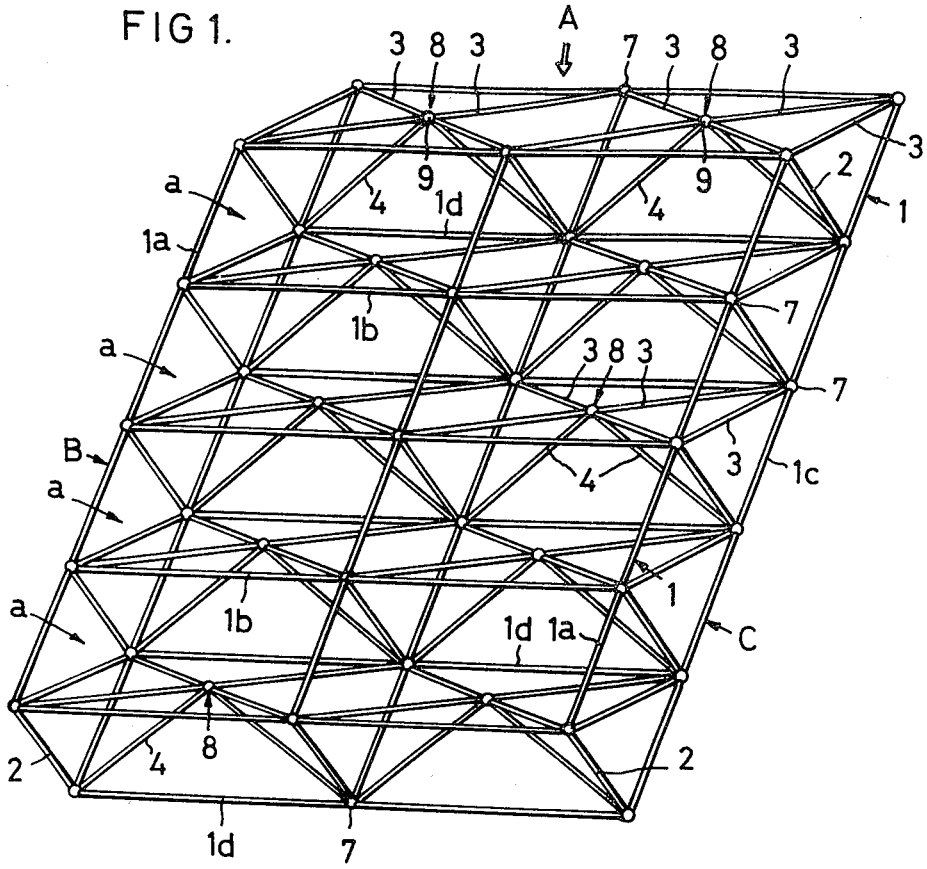
FIG. 1 is a perspective view of an artificial land structure framework according to the present invention, showing its basic structure.
Figure 2:
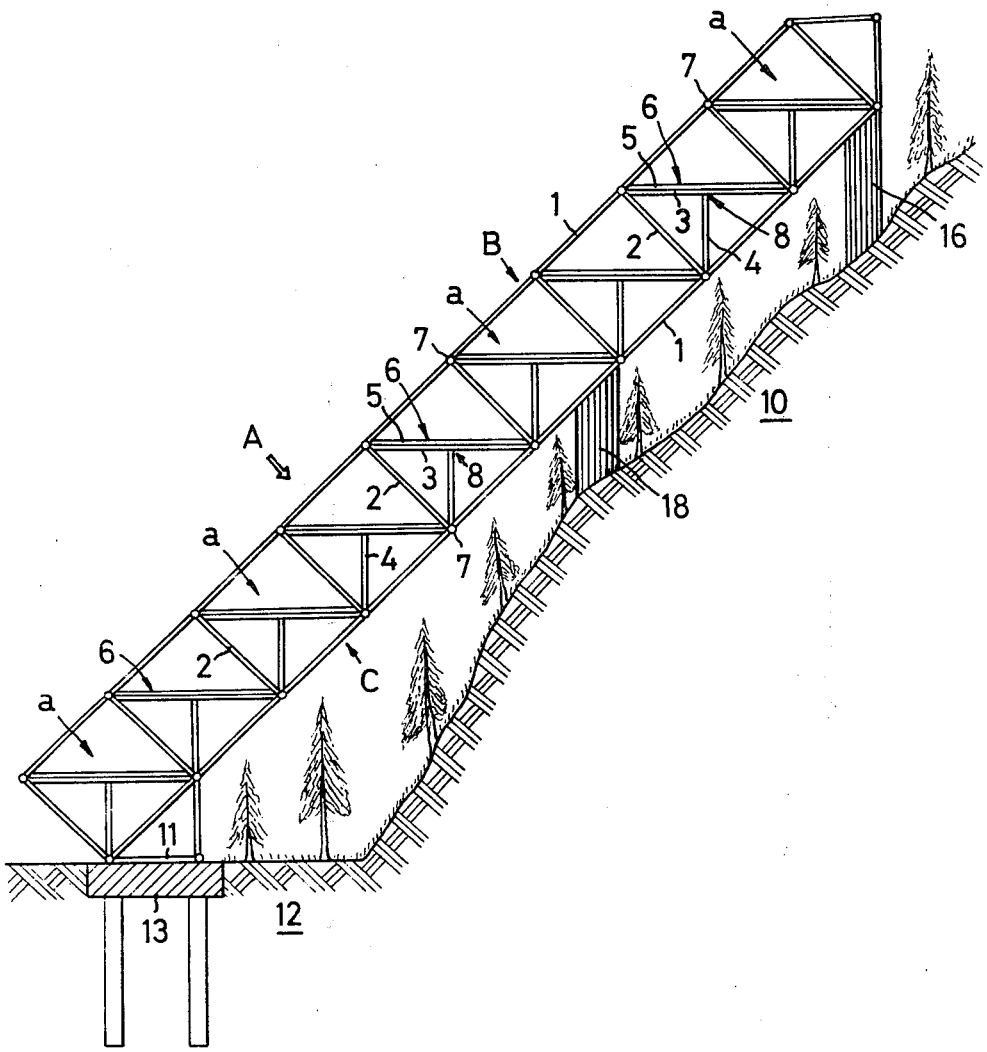
FIG. 2 is a side view of an artificial land constructed on an inclined land using the artificial land framework according to the present invention shown in FIG. 1.

Now referring to the attached drawings, FIGS. 1 and 2 show basic patterns of the artificial land structure framework according to the present invention.

In FIGS. 1 and 2, a structure framework A comprises main beam members 1, auxiliary beam members 2, land beam members 3, reinforcing beam members 4, artificial land materials 5 and artificial lands 6.

Each of the above-mentioned members is made of material having sufficient strength such as steel, aluminum alloy or plastics, and these members are connected in the following manner to form a structure framework according to the present invention.

The above main beam members 1 consist of upper longitudinal chord members 1*a*, upper lateral chord members 1*b*, lower longitudinal chord members 1*c* and lower lateral chord members 1*d*. An upper framework or grid B and a lower framework or grid C are formed by connecting a plurality of upper longitudinal chord members 1*a*, upper lateral chord members 1*b*, lower longitudinal chord members 1*c* and lower lateral chord members 1*d* at predetermined intervals in the longitudinal and lateral directions, respectively. The upper and lower grids B and C are connected at joints 7 of the longitudinal and lateral chord members by auxiliary beam members 2 thereby forming a large number of three-dimensional rectangular spaces *a* which are defined by the main beam members 1 and auxiliary beam members 2 and are disposed continuously and two-dimensionally. Each of these spaces *a* is halved by land beam members 3 connected to the joints 7 along the diagonal lines thereof, and the intersecting points 8 of the land beam members 3 and the joints 7 belonging to the lower grid C are connected by reinforcing-beam members 4. Thus the framework A of a truss structure is formed. The framework A thus constructed is provided with the artificial land 6 made of land materials 5 such as deck plates fixed on the land beam members 3.

The aforementioned artificial land 6 is provided along the diagonal lines in each of the spaces *a* continuously and two-dimensionally formed. Therefore, if the framework A is supported obliquely, as shown in FIG. 2, so that the artificial lands 6 may be placed horizontally and stepwise, the sunshine and ventilation for the spaces *a* are well insured, and the spaces *a* at the same story communicate with each other so that transportation between any two thereof may be maintained.

The above-mentioned members are so designed that they may be mass produced in a factory and thereby be standardized, may be used for various purposes by combining various types of members, may have multiple structural functions, and may be produced inexpensively.

Figure 11:
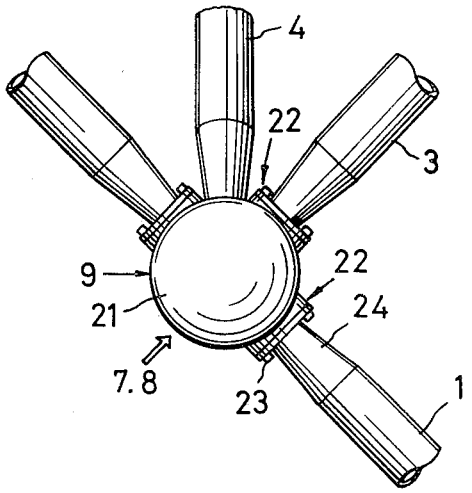
FIG. 11 is an elevational view showing an embodiment of a joint for use in connecting the main and auxiliary beam members.

These members are flexible in utility so that they may be rapidly assembled and disassembled by the use of, for instance, ball joints, bolts, nuts, etc. as shown in FIG. 11, thereby enabling extension or reduction of the framework or extension of a modified framework hereinafter described.

FIG. 2 shows an embodiment of a framework A having the above-mentioned construction, which is constructed on an inclined land surface 10.

As shown in FIG. 2, the structure framework A has at the rear side of its bottom a support 11 previously assembled therein in accordance with the inclination of the land 10. A support bed 13 is provided in the supporting land 12 for supporting the support 11. The support bed 13 is made of, for instance, reinforced concrete. Posts 16 are provided at suitable positions on the inclined land surface 10 for supporting the framework A. Thus the framework A can be supported securely by the support bed 13 and posts 16, thereby minimizing the nature destruction. As mentioned above, the artificial lands 6, which are privided on the diagonal lines in the respective spaces *a*, are placed horizontally and, in addition, stepwise along the inclined land 10. Since the framework A is a truss structure which is composed of land members 3 dividing each of the spaces *a* in two along its diagonal lines, and reinforcing members 4 provided between the intersecting points 8 of the land members 3 and the joints 7 of the main and auxiliary members 1 and 2, the framework A has a mechanical strength sufficient to withstand the load applied on the artificial land 6 ensuring complete safety.

Figure 3:
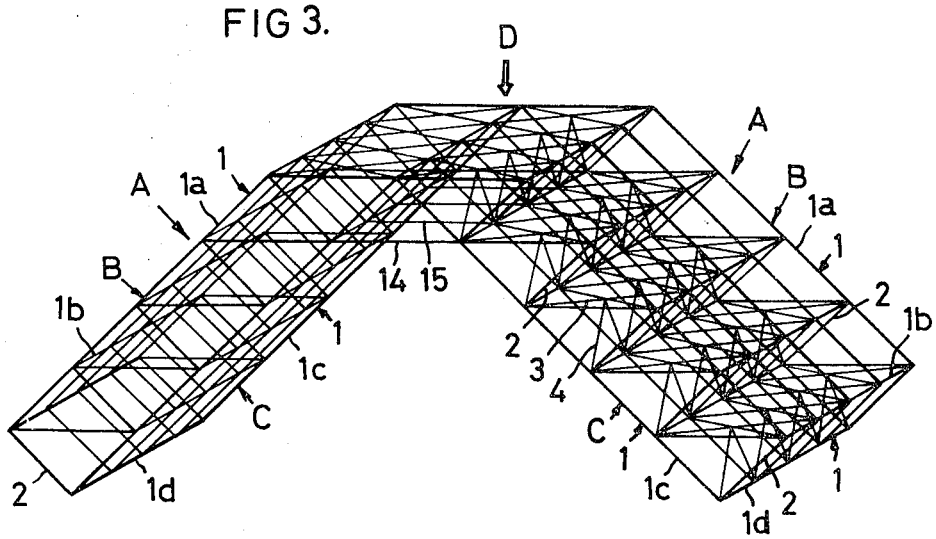
FIG. 3 is a perspective view of a gabled artificial land framework obtained by combining the basic structures shown in FIG. 1.

FIGS. 3, 4A and 4B are schematic views of modifications according to the present invention, illustrating gabled frameworks. In FIG. 3 and 4A, and 4B the above-mentioned two basic structure frameworks A are symmetrically disposed at a certain angle with each other. These two frameworks A are combined by connecting their joints 7 with each other using external and internal tie members 14 and 15 and reinforcing members 4, thereby to form a ridge structure. Each of the said two structure frameworks A composing a gabled structure D has upper and lower grids B and C constituted of the longitudinal and lateral upper chord members 1*a* and 1*b* and the longitudinal and lateral lower chord members 1*c* and 1*d* which are connected keeping given distances therebetween, respectively.

In the gabled framework D shown in FIG. 4A, a structure framework A*a* has an upper grid B which is so constructed that its longitudinal upper chord members 1*a* may be provided at every other position, that is, at an interval of twice that of the longitudinal lower chord members 1*c* of the lower grid C. In a gabled framework D shown in FIG. 4B, upper and lower grids B and C are constructed in the same manner as in the case shown in FIG. 3, but auxiliary beam members 2 connecting the upper and lower grids B and C are disposed in a zigzag manner thereby forming a structure framework A*b*.

Thus the framework D shown in FIG. 4A or 4B is composed of the frameworks A*a* or A*b* connected to each other by tie members and reinforcing members in the similar way to FIG. 3.

Figure 5:
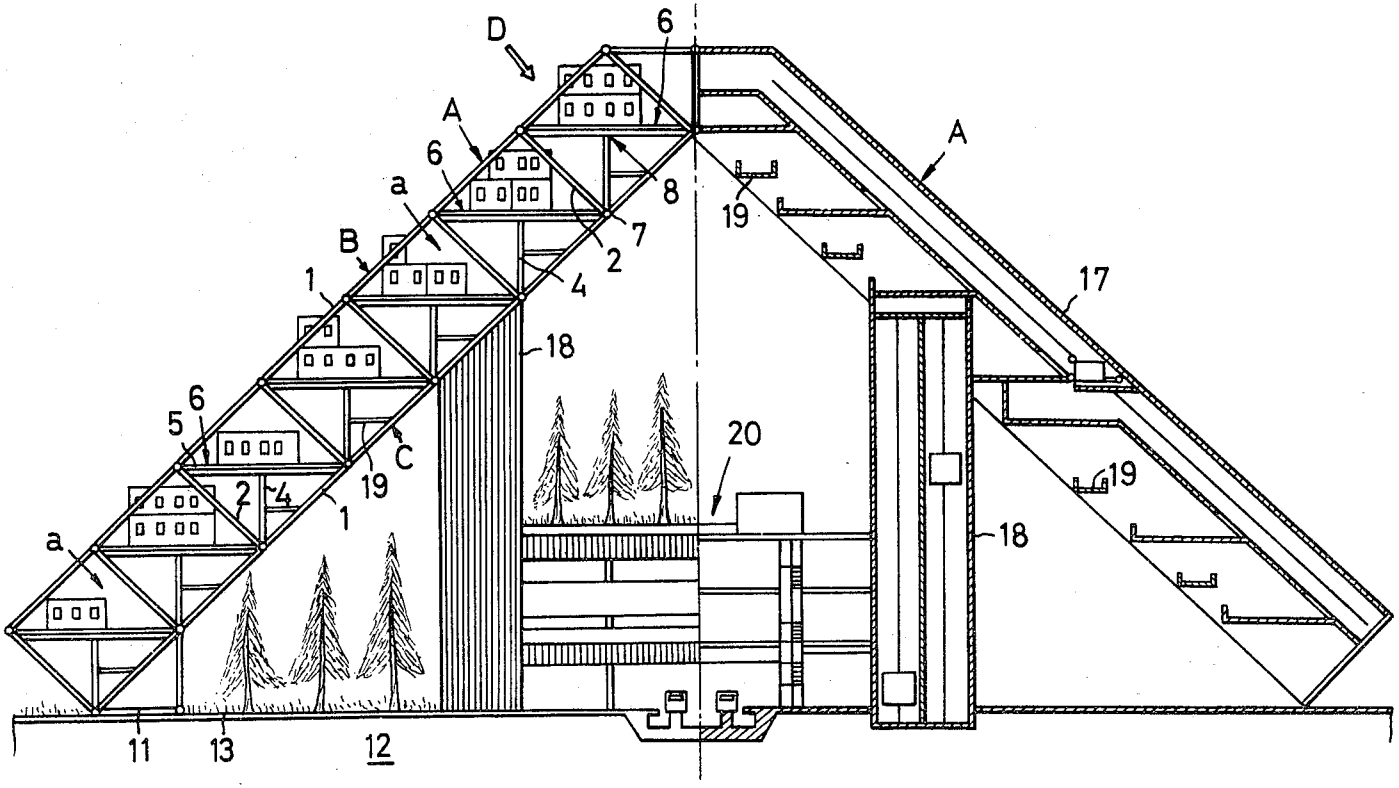
FIG. 5 is a side view, partially in section, of the gabled artificial land framework of FIG. 3 constructed on flat ground.
Figure 6:
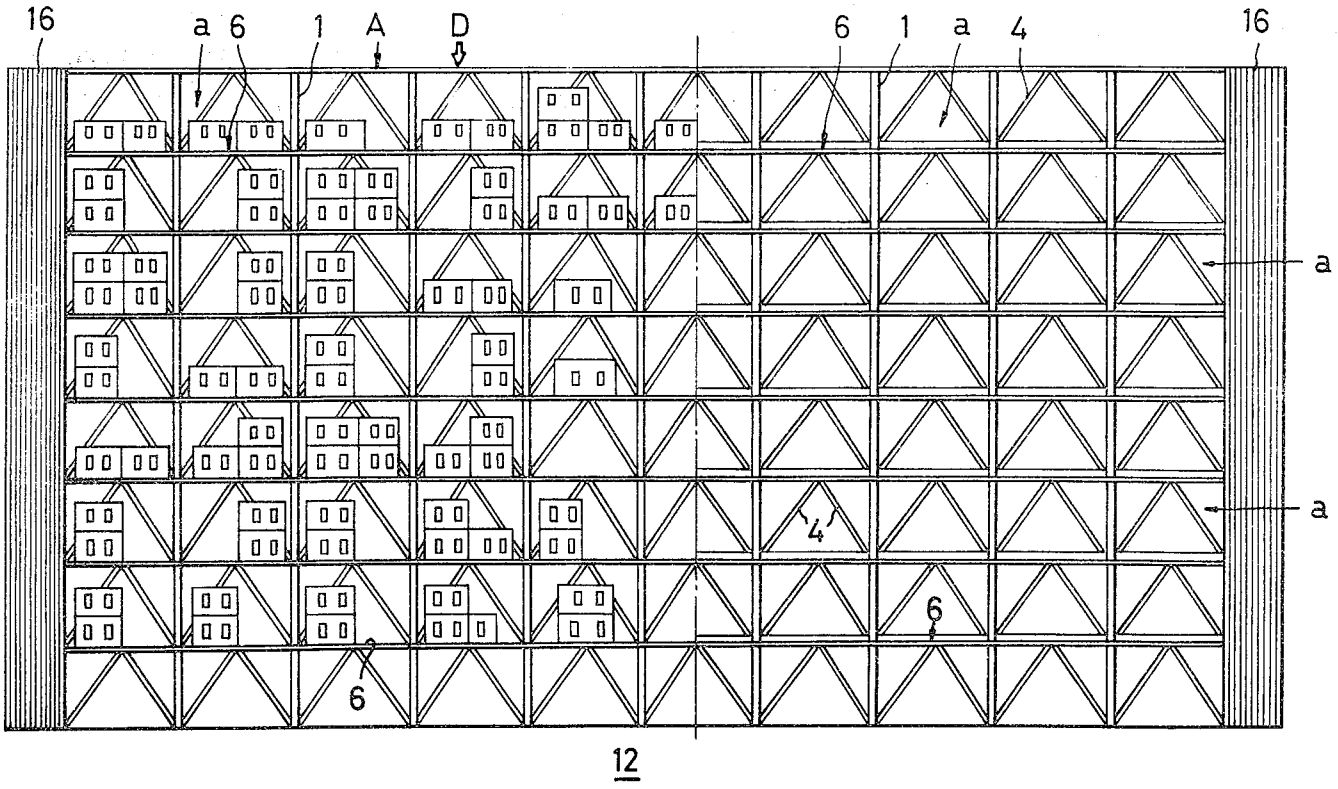
FIG. 6 is an elevational view of the gabled artificial land framework shown in FIG. 5.

FIGS. 5 and 6 are a side view partially in section and a plan view of the above-mentioned gabled framework D constructed on a support layer 12 of a flat land.

As shown in the drawings, the gabled framework D is provided at the bottom ends of right and left sides thereof with supports 11 previously assembled therein. The framework D is supported by the supports 11 fixed to the support bed 13 made of reinforced concrete formed in the support layer 12.

Thus the artificial lands 6 are constructed stepwise. As is apparent from FIG. 5, there is provided an elevator hall 17 communicating with artificial lands of each floor, elevators 18, passages 19 for respective floors, and city facilities 20 including a community center, shops, sewerage and waterworks, waste treating equipment, gas equipment, electrical equipment, airconditioning equipment, telephone and communication equipment, etc. In this manner, transportation or communication between the spaces *a* on the same floor or different floors can be smoothly made.

Figure 7:
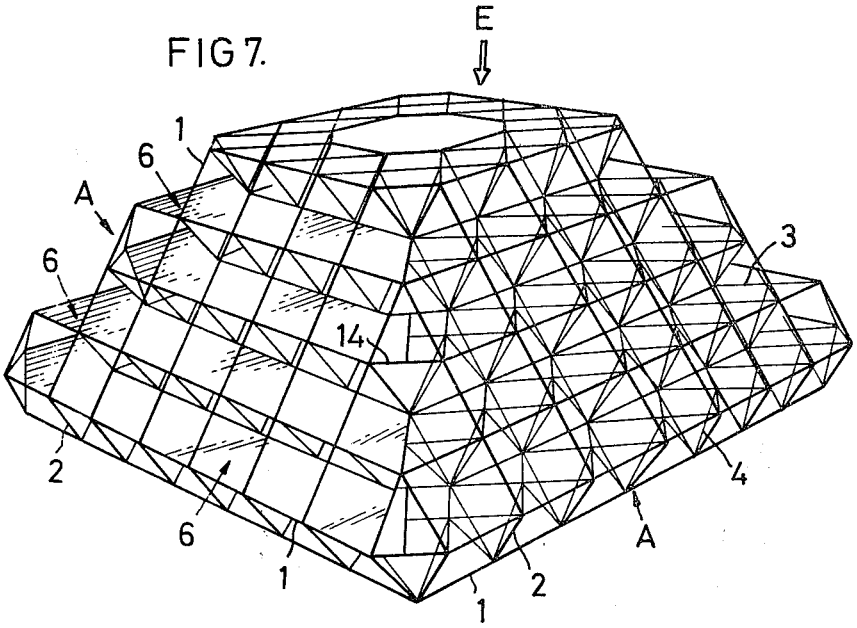
FIG. 7 is a perspective view of a pyramid type framework constructed by combining the basic structures shown in FIG. 1 using tie members.
Figure 8:
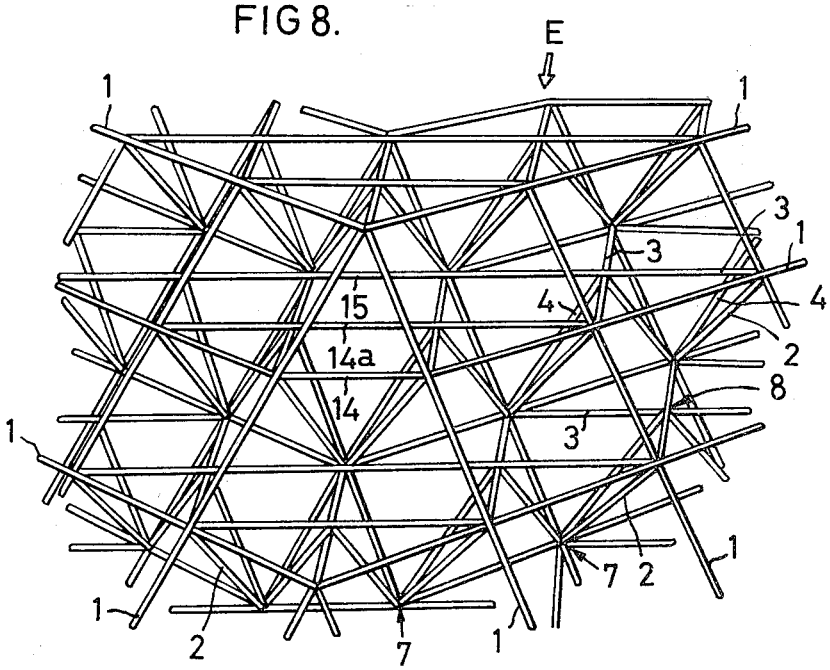
FIG. 8 is an enlarged view of a corner portion of the pyramid type framework of FIG. 7, showing its connections.

FIG. 7 shows a modification of the present invention, illustrating a pyramid type framework, and FIG. 8 shows an enlarged view of the same. As shown in the drawing, the above-mentioned framework A is so constructed that at the right and left sides of the framework A, the area of the artificial lands 6 may be decreased by a half of the land formed within one space, layer after layer from the bottom to the top.

Four frameworks A thus constructed are disposed like a pyramid. The adjacent frameworks A are combined by connecting their joints 7 of the main, auxiliary and reinforcing members using external tie members 14, intermediate tie members 14*a* and internal tie members 15 thereby forming a pyramid-shaped framework E, as shown in FIG. 8. Thus the artificial lands 6 are formed stepwise at four sides. In this case, there are also provided elevators, passages and other city facilities as in the case of the gabled framework D.

The pyramid-shaped framework E can be constructed on a flat or terraced land in the same manner as in the case of the gabled framework D.

FIG. 9A is a plan view of a tapered framework F according to the present invention and FIG. 9B is a side view thereof. If the distance between the two adjoining main beam members 1 is assumed to be one span, as shown in FIG. 9A and B, the framework F is unilaterally tapered in the direction of the X-axis of the drawing and has the stepped artificial lands 6 which are formed upwardly toward the top and downwardly from the top to the bottom by one layer at intervals of one span in the direction of Y-axis and are formed downwardly by one layer at intervals of two span in the direction of X-axis.

FIG. 10A is a plan view of a bilaterally tapered framework G according to the present invention, and FIG. 10B is a side view of the same. As shown in FIGS. 10A and 10B, the framework G is bilaterally tapered in the direction of X-axis and has the artificial lands 6 which are increased by one layer at intervals of one span in the direction of both X-axis and Y-axis.

In the cases of both the unilaterally- and bilaterally-tapered frameworks, the grids F*a* or G*a* at both sides are imparted with a taper by connecting the longitudinal main beam members with the lateral main beam members at an acute or obtuse angle, and these grids are connected with each other by suitable tie rods, as mentioned above.

FIG. 11 shows an example of a joint used for easily connecting or disassemblying the above-mentioned main beam members 1, auxiliary beam members 2, ground members 3, reinforcing beam members 4, tie members 14, 14*a* and 15, etc., and the reference numeral 9 illustrates a ball joint. As shown in FIG. 11, the ball joint 9 has on the periphery of its ball 21 a plurality of connections 22 equipped with bolts. The ends 24 of the beam members are previously made to fit to the above-mentioned connections 22 and are connected thereto by bolts and nuts 23 thereby to connect each beam member. However, it is apparent that the means for connecting the respective beam members according to the present invention are not limited to the aforementioned ball joint, but may be any known connecting means if they can easily be used to connect or disassemble the beam members.

Figure 12:
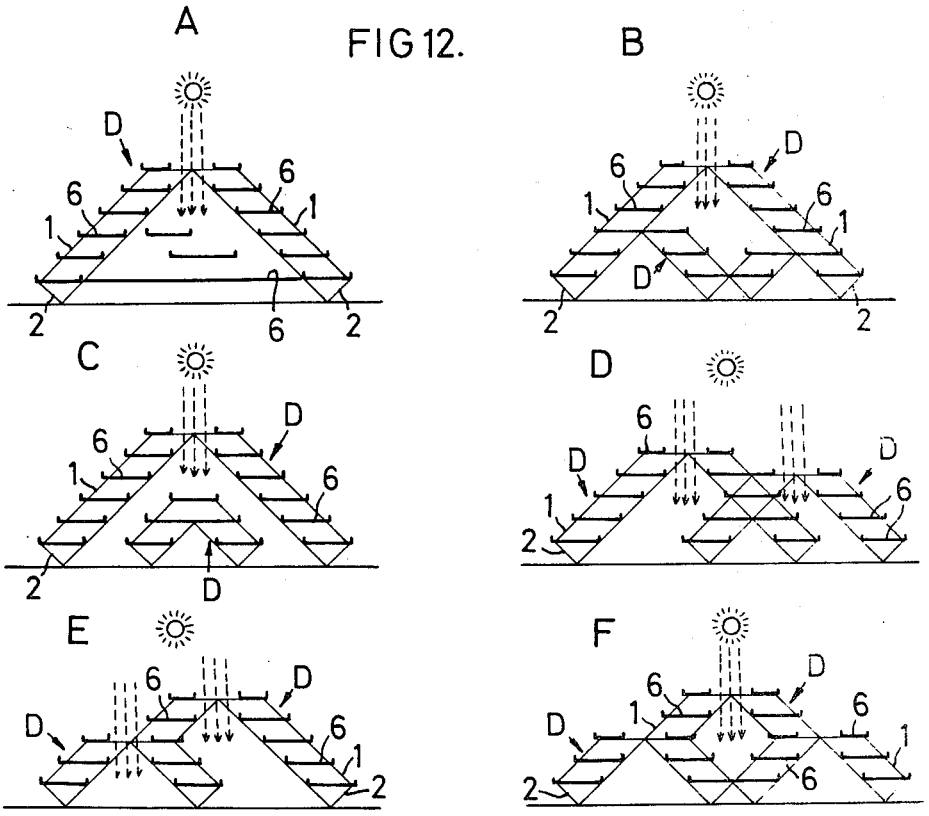
FIG. 12 shows basic sectional patterns of the framework according to the present invention.

FIG. 12 shows various modifications of the aforementioned gabled framework D, which are disposed to effectively and variedly utilize the gigantic triangular spaces covered with terraced artifical lands. FIG. 12A shows an example in which independent artificial lands are provided in the triangular space separately from the ridge or angle structure. FIGS. 12B to 12F show examples each of which has at least one ridge structure combined with the original ridge structure.

Figure 13:
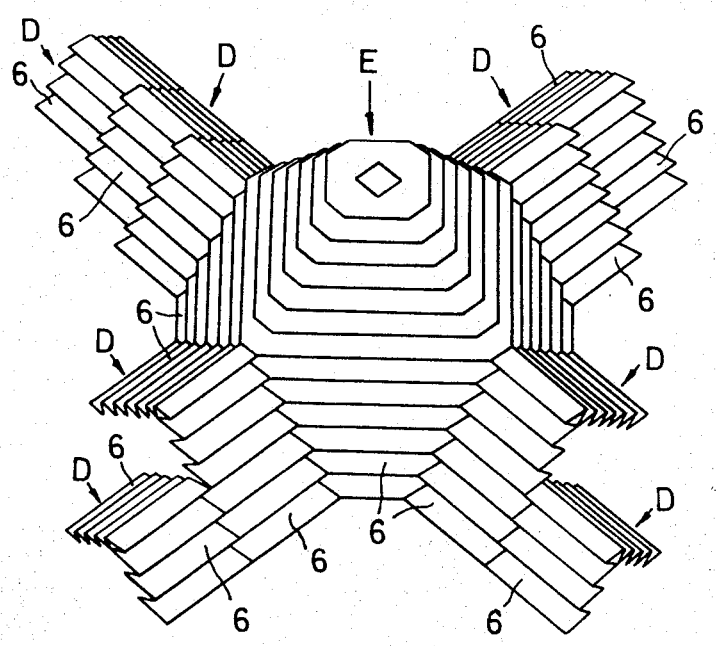
FIG. 13 is a perspective view showing another embodiment of the framework according to the present invention.

FIG. 13 shows an example which combines the aforementioned gabled structures and a pyramid-shaped framework.

It is apparent from the foregoing description that the structure framework according to the present invention can provide various multi-purpose artificial lands besides the above-mentioned examples.

What we claim is:

1. A massive polyhedral framework for supporting artificial lands and buildings comprising:

standardized main beam members;
auxiliary beam members;
land beam members;
reinforcing beam members;
artificial land surface materials;
connecting means for releasably connecting said beam members together;
upper and lower grids formed by connecting said main beam members through said connecting means in the longitudinal and lateral directions at intervals of a predetermined span, said upper and lower grids being connected by said auxiliary beam members through said connecting means to form a number of three-dimensional spaces continuously disposed two-dimensionally, said two land beam members being provided along the diagonal lines extending through said three-dimensional spaces, the intersecting points of said land beam members being connected to the joints of said main and auxiliary beam members through said reinforcing beam members, said land surface materials being provided on said land beam members to form said artificial lands dividing said spaces in two, said artificial lands being disposed stepwise; and
tie members for connecting a plurality of said upper and lower grids together to form the polyhedral framework provided with said stepwise-disposed artificial lands, and
wherein a plurality of said upper and lower grids are connected in a gabled style by said tie members.

2. A massive polyhedral framework for supporting artificial lands and buildings comprising:

standardized main beam members;
auxiliary beam members;
land beam members;
reinforcing beam members;
artificial land surface materials;
connecting means for releasably connecting said beam members together;
upper and lower grids formed by connecting said main beam members through said connecting means in the longitudinal and lateral directions at intervals of a predetermined span, said upper and lower grids being connected by said auxiliary beam members through said connecting means to form a number of three-dimensional spaces continuously disposed two-dimensionally, said two land beam members being provided along the diagonal lines extending through said three-dimensional spaces, the intersecting points of said land beam members being connected to the joints of said main and auxiliary beam members through said reinforcing beam members, said land surface materials being provided on said land beam members to form said artificial lands dividing said spaces in two, said artificial lands being disposed stepwise; and
tie members for connecting a plurality of said upper and lower grids together to form the polyhedral framework provided with said stepwise-disposed artificial lands, and
wherein a plurality of said upper and lower grids are connected in a pyramid-like manner by said tie members.

3. A massive polyhedral framework as set forth in claim 2, wherein an additional plurality of upper and lower grids is connected together by additional tie members to form a gabled framework, and including tie rods connecting said gabled framework to said pyramid-like framework.

4. A massive polyhedral framework for supporting artificial lands and buildings comprising:

standardized main beam members;
auxiliary beam members;
land beam members;
reinforcing beam members;
artificial land surface materials;
connecting means for releasably connecting said beam members together;
upper and lower grids formed by connecting said main beam members through said connecting means in the longitudinal and lateral directions at intervals of a predetermined span, said upper and lower grids being connected by said auxiliary beam members through said connecting means to form a number of three-dimensional spaces continuously disposed two-dimensionally, said two land beam members being provided along the diagonal lines extending through said three-dimensional spaces, the intersecting points of said land beam members being connected to the joints of said main and auxiliary beam members through said reinforcing beam members, said land surface materials being provided on said land beam members to form said artificial lands dividing said spaces in two, said artificial lands being disposed stepwise; and tie members for connecting a plurality of said upper and lower grids together to form the polyhedral framework provided with said stepwise-disposed artificial lands, wherein said longitudinally-connected main beam members are connected to said laterally connected main beam members at other than a right angle, whereby said three-dimensional spaces form parallelogrammic three-dimensional spaces connected to each other through said tie members to form gabled structures, said gabled structures being arranged vertically in a stepwise manner at intervals of one span, and bilaterally tapered in the horizontal direction.

5. A massive polyhedral framework for supporting artificial lands and buildings comprising:

standardized main beam members;

auxiliary beam members;

land beam members;

reinforcing beam members;

artificial land surface materials;

connecting means for releasably connecting said beam members together;

upper and lower grids formed by connecting said main beam members through said connecting means in the longitudinal and lateral directions at intervals of a predetermined span, said upper and lower grids being connected by said auxiliary beam members through said connecting means to form a number of three-dimensional spaces continuously disposed two-dimensionally, said longitudinally-connected main beam members being connected to said laterally connected main beam members at other than a right angle, whereby said three-dimensional spaces comprise parallelogrammic three-dimensional spaces, said two land beam members being provided along the diagonal lines extending through said three-dimensional spaces, the intersecting points of said land beam members being connected to the joints of said main and auxiliary beam members through said reinforcing beam members, said land surface materials being provided on said land beam members to form said artificial lands dividing said spaces in two, said artificial lands being disposed stepwise; and tie members for connecting a plurality of said upper and lower grids together to form the polyhedral framework provided with said stepwise-disposed artificial lands;

said framework further comprising in combination a further massive polyhedral framework and tie rods connecting said first mentioned massive polyhedral framework to said further massive polyhedral framework, said further massive polyhedral framework comprising:

further standardized main beam members;

further auxiliary beam members;

further land beam members;

further reinforcing beam members;

further artificial land surface materials;

further connecting means for releasably connecting said further beam members together;

further upper and lower grids formed by connecting said further main beam members through said further connecting means in the longitudinal and lateral directions at intervals of a predetermined span, said further upper and lower grids being connected by said further auxiliary beam members through said further connecting means to form a number of further three-dimensional spaces continuously disposed two-dimensionally, said further land beam members provides along the diagonal lines of said further three-dimensional spaces, the intersecting points of said further land beam members being connected to the joints of said further main and auxiliary beam members through said further reinforcing beam members;

said further land surface materials being provided on said further land beam members to form further artificial lands dividing said further spaces in two, said further artificial lands being disposed stepwise; and further tie members for connecting a plurality of said further spaces with each other through said further connecting means, whereby a plurality of said further spaces are connected with each other through said further tie members to form the further massive polyhedral framework provided with said stepwise-disposed further artificial lands;

and wherein said longitudinally-connected further main beam members are connected to said laterally-connected further main beam members at a right angle, whereby said further three-dimensional spaces comprise rectangular parallelpipeds.

6. A massive framework for supporting artificial lands and buildings, comprising:

elongated upper lateral chords;

elongated upper longitudinal chords;

upper connecting means, each upper connecting means releasably connecting the end of an associated upper lateral chord with the end of an associated upper longitudinal chord at a right angle and in an upper plane to form an upper rectangular grid;

elongated lower lateral chords;

elongated lower longitudinal chords;

lower connecting means, releasably connecting the end of an associated lower lateral chord with the end of an associated lower longitudinal chord at a right angle and in a lower plane to form a lower rectangular grid;

auxiliary members, one end of each member being releasably connected to an associated one of said upper connecting means and the other end of each member being releasably connected to an associated one of said lower connecting means, said beams being oriented at right angles to said chords so that said upper and lower rectangular grids are spaced from each other to form a rectangular parallelpiped outline;

land-support beams positioned in a plane diagonally bisecting said rectangular parallelpiped outline, one of said land-support beams extending diagonally through said outline and having one end connected to one of said upper connecting means and the other end connected to one of said lower connecting means, the other of said land-support beams extending diagonally through said outline and having one end connected to another of said upper connecting means and the other end connected to another of said lower connecting means;

connecting joints for connecting two said land-support beams where they intersect each other at their mid lengths; and reinforcing members, one end of each said reinforcing members being joined to said connecting joint, and the other end of each of said reinforcing members being connected to different ones of said lower connecting means below said diagonal plane, whereby said framework can be oriented so that said diagonal plane is horizontal;

wherein said chords, means, joints, members, and beams are positioned to repeat said upper and lower rectangular grids in their respective planes and form a plurality of said rectangular parallelpiped outlines interconnected together and sharing adjacent chords, connecting means and auxiliary members, whereby said land-support beams provide support for a plurality of artificial lands and buildings vertically and horizontally effect from each other.

* * * * *